United States Patent [19]

Cheung

[11] 4,448,595

[45] May 15, 1984

[54] SPLIT COLUMN MULTIPLE CONDENSER-REBOILER AIR SEPARATION PROCESS

[75] Inventor: Harry Cheung, Buffalo, N.Y.

[73] Assignee: Union Carbide Corporation, Danbury, Conn.

[21] Appl. No.: 446,400

[22] Filed: Dec. 2, 1982

[51] Int. Cl.[3] ..... F25J 3/04

[52] U.S. Cl. ..... 62/31; 62/34

[58] Field of Search ..... 62/12, 13, 23, 24, 27–32, 62/34, 38, 39, 42, 43

[56] References Cited

U.S. PATENT DOCUMENTS

| | | | |
|---|---|---|---|
| 3,270,514 | 9/1966 | Kamlani | 62/29 |
| 3,348,385 | 10/1967 | Kamlani et al. | 62/29 |
| 4,222,756 | 9/1980 | Thorogood | 62/13 |

*Primary Examiner*—Frank Sever

*Attorney, Agent, or Firm*—Stanley Ktorides

[57] ABSTRACT

A cryogenic process to efficiently produce large quantities of nitrogen gas at elevated pressure and optionally some oxygen by use of a split column and multiple condenser-reboilers.

22 Claims, 2 Drawing Figures

SPLIT COLUMN MULTIPLE CONDENSER-REBOILER AIR SEPARATION PROCESS

TECHNICAL FIELD

This invention relates generally to the field of cryogenic separation of air and more particularly to the field of cryogenic separation of air to produce nitrogen.

BACKGROUND ART

A use of nitrogen which is becoming increasingly more important is as a fluid for use in secondary oil or gas recovery techniques. In such techniques a fluid is pumped into the ground to facilitate the removal of oil or gas from the ground. Nitrogen is often the fluid employed because it is relatively abundant and because it does not support combustion. When nitrogen is employed in such enhanced oil or gas recovery techniques it is generally pumped into the ground at an elevated pressure which may be from 500 to 10,000 psia or more.

Often it is desirable to have available oxygen, either at ambient or elevated pressure, for use in a process proximate to that which uses elevated pressure nitrogen. For example, in one such situation it may be desirable to supply lower purity oxygen for combustion purposes to generate synthetic fuels and elevated pressure nitrogen for enhanced oil or gas recovery. Another such combined product application could be in metal refineries and metal-working operations which can utilize elevated pressure nitrogen for blanketing purposes and low purity oxygen for combustion; some high purity oxygen could also be used for metal working operations. Still another application could be in chemical processes where the nitrogen is used for blanketing and the oxygen is used as a chemical reactant. Although there are known processes to produce nitrogen and oxygen, it would be desirable to have a process which can produce large quantities of elevated pressure nitrogen and also produce some oxygen.

A known process to produce nitrogen and oxygen employs compressed feed air to reboil the lower pressure column bottoms. Such a process is generally termed an "air boiling" or a "split column" process. A split column process may be advantageous over a double column process because it can have improved separation efficiency and can have lower equipment costs. For this reason, it would be desirable to have a split column process which can produce large quantities of elevated pressure nitrogen and it would also be desirable to have a split column process which can produce large quantities of elevated pressure nitrogen and also some oxygen.

It is therefore an object of this invention to provide a split column air separation process which will produce large quantities of nitrogen at elevated pressure and at a high separation efficiency.

It is a further object of this invention to provide a split column air separation process which will produce large quantities of nitrogen at elevated pressure and at a high separation efficiency while also producing some oxygen.

SUMMARY OF THE INVENTION

The above and other objects which will become obvious to one skilled in the art upon a reading of this disclosure are attained by:

A process for the production of nitrogen gas at greater than atmospheric pressure by the separation of air by rectification comprising:

(A) introducing cleaned, cooled feed air at greater than atmospheric pressure into a high pressure column operating at a pressure of from about 80 to 300 psia;

(B) separating said feed air by rectification in said high pressure column into a first nitrogen-rich vapor fraction and a first oxygen-enriched liquid fraction;

(C) recovering from about 0 to 60 percent of said first nitrogen-rich vapor fraction as high pressure nitrogen gas;

(D) condensing at least a portion of said first nitrogen-rich vapor fraction by indirect heat exchange with said first oxygen-enriched liquid fraction thereby producing a first nitrogen-rich liquid portion and a first oxygen-enriched vapor fraction;

(E) employing at least some of said first nitrogen-rich liquid portion as liquid reflux for said high pressure column;

(F) introducing said first oxygen-enriched vapor fraction into a medium pressure column operating at a pressure, lower than that of said high pressure column, of from about 40 to 50 psia;

(G) separating said first oxygen-enriched vapor fraction by rectification in said medium pressure column into a second nitrogen-rich vapor fraction and a second oxygen-enriched liquid fraction;

(H) vaporizing a portion of said second oxygen-enriched liquid fraction by indirect heat exchange with cleaned, cooled feed air at a pressure of from about 80 to 350 psia, thereby producing a first oxygen-enriched vapor portion, for use as vapor reflux in said medium pressure column, and liquid air;

(I) dividing said liquid air into a first part, which is introduced into said high pressure column wherein it is separated by rectification into parts which comprise the first nitrogen-rich vapor fraction and the first oxygen-enriched liquid fraction, and into a second part, which is introduced into said medium pressure column wherein it is separated by rectification into parts which comprise the second nitrogen-rich vapor fraction and the second oxygen-enriched liquid fraction;

(J) recovering from about 0 to 60 percent of said second nitrogen-rich vapor fraction as medium pressure nitrogen gas;

(K) condensing at least a portion of said second nitrogen-rich vapor fraction by indirect heat exchange with a portion of said second oxygen-enriched liquid fraction thereby producing a second oxygen-enriched vapor portion and a second nitrogen-rich liquid portion;

(L) employing said second nitrogen-rich liquid portion as liquid reflux for said medium pressure column;

(M) employing said first nitrogen-rich liquid portion as additional reflux for said medium pressure column in an amount equivalent to that of from about 0 to 60 percent of said first nitrogen-rich vapor fraction such that the sum of said amount and of the high pressure nitrogen gas recovered in step (C) is from about 0 to 60 percent of said first nitrogen-rich vapor fraction; and (N) removing from the process said second oxygen-enriched vapor portion.

The term "indirect heat exchange", as used in the present specification and claims, means the bringing of two fluid streams into heat exchange relation without any physical contact or intermixing of the fluids with each other.

The term, "column", as used in the present specification and claims, means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, chapter VII, Commercial Air Separation.

Vapor and liquid contacting separation processes depend on the difference in vapor pressures for the components. The high vapor pressure (or more volatile or low boiler) component will tend to concentrate in the vapor phase whereas the low vapor pressure (or less volatile or high boiler) will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phase. The countercurrent contacting of the vapor and liquid phases is adiabatic and can include integral or differential contact between the phases. Separation process arrangements that utilize the principle of rectification to separate mixtures are often interchangeably termed rectification columns, distillation columns, or fractionation columns.

The term "cleaned, cooled air" as used in the present specification and claims, means air which has been cleaned of impurities such as water vapor and carbon dioxide and is at a temperature below about 120° K., preferably below about 110° K.

The term "reflux ratio", as used in the present specification and claims, means the numerical ratio of the liquid flow to the vapor flow each expressed on a molal basis, that are countercurrently contacted within the column to effect separation.

The term "split column", as used in the present specification and claims, means a separated pair of columns not in indirect heat exchange relationship wherein a lower pressure column is reboiled by an air feed fraction while a higher pressure column separates another air feed fraction.

The term "equivalent", as used in step (M), is used in order to express a liquid in terms of a vapor and, as such, means equivalent on a mass basis rather than, for example, a volume basis.

DETAILED DESCRIPTION

The process of this invention will be described in detail with reference to the drawings.

Figure 1:
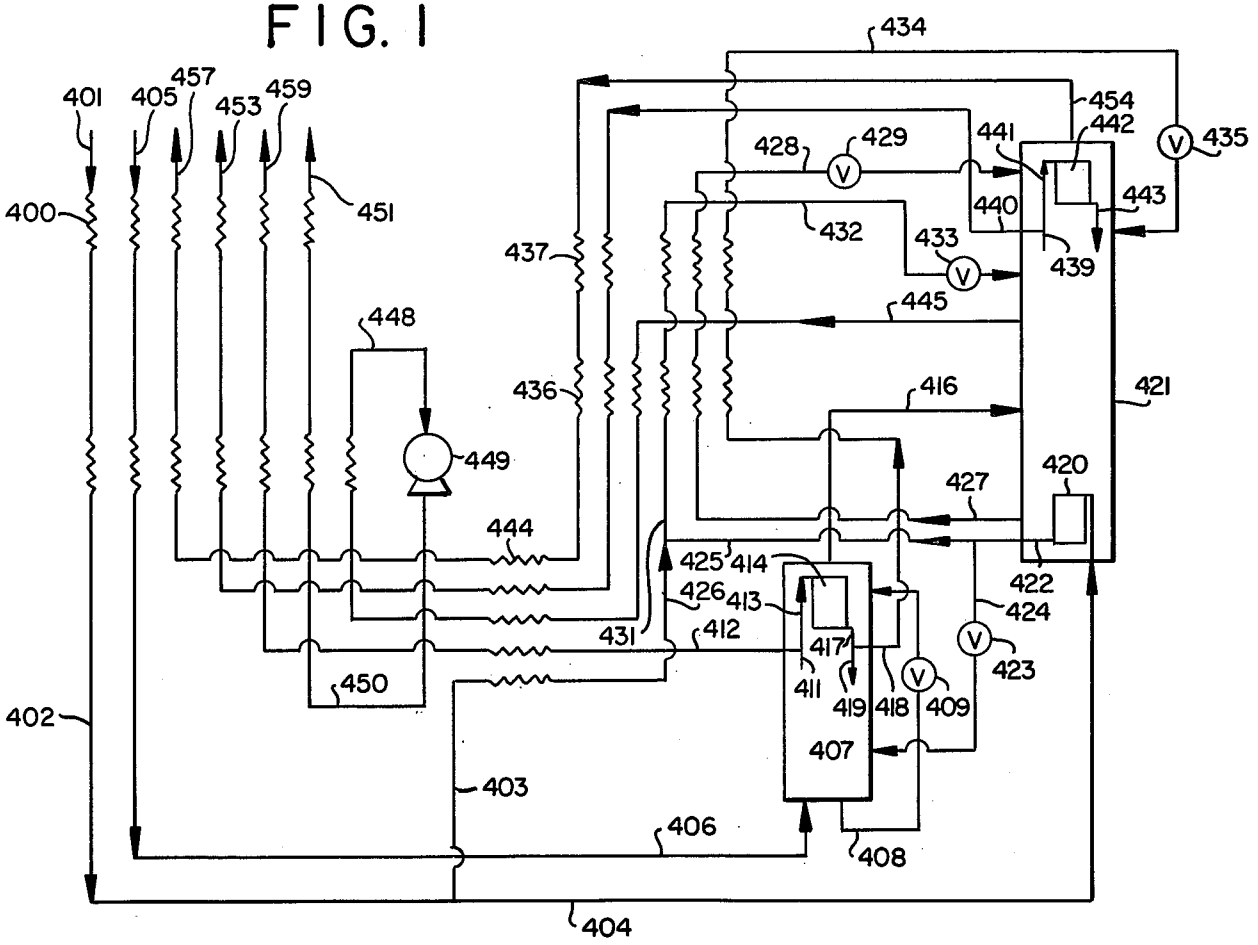
FIG. 1 is a schematic representation of one preferred embodiment of the process of this invention.

FIG. 1 illustrates one embodiment of the process of this invention wherein some product oxygen is produced in addition to elevated pressure nitogren. Referring now to FIG. 1, pressurized feed air streams 401 and 405 are passed through desuperheater 400 where they are cooled and cleaned of impurities, such as water vapor and carbon dioxide, and from where they emerge in a close-to-saturated condition at 402 and 406 respectively. The feed air is supplied in two portions, 401 and 405, because the split column process generally requires for efficient operation that air be supplied at two different pressures with the air supplied to the main condenser at a higher pressure than that supplied to the higher pressure column.

A minor fraction 403 of feed air stream 402 is employed to superheat return streams through heat exchanger 444 resulting in condensed liquid air stream 426. The major fraction 404 of stream 402 is introduced at a pressure of from about 80 to 350 psia to condenser 420 at the bottom of medium pressure column 421 which is operating at a pressure of from about 40 to 150 psia, preferably from about 45 to 120 psia, most preferably from about 50 to 90 psia. In condenser 420 the feed air is condensed by indirect heat exchange with the medium pressure column bottoms to liquid air. The liquid air is withdrawn from condenser 420 as stream 422 which is divided into portion 425 and into portion 424 which is expanded through valve 423 and introduced into high pressure column 407 which is operating at a pressure of from about 80 to 300 psia, preferably from about 90 to 240 psia, most preferably from about 100 to 200 psia. Stream 406 is also introduced into column 407 at the bottom of the column. Preferably portion 424 comprises from about 30 to 60 percent of stream 422, most preferably from 40 to 50 percent, and portion 425 comprises from 40 to 70 percent of stream 422, most preferably from 50 to 60 percent.

In column 407 the feed air is separated by rectification into a first nitrogen-rich vapor fraction and a first oxygen-enriched liquid fraction. The first nitrogen-rich vapor fraction 411 is divided into portion 412 which comprises from 0 to 60 percent of fraction 411 and which is removed from column 407, warmed by passage through heat exchanger 444 and desuperheater 400 and recovered as product high pressure nitrogen gas at about ambient temperature. The remaining portion 413 of the first nitrogen-rich vapor is introduced into condenser 414 where it is condensed by indirect heat exchange with the first oxygen-enriched liquid fraction which is removed from the bottom of column 407 as stream 408 and expanded through valve 409 into top condenser 414. The resulting first oxygen-enriched vapor fraction is removed from condenser 414 as stream 416 and introduced into column 421 as feed while the resulting first nitrogen-rich liquid portion is removed from condenser 414 as stream 417 and at least some of stream 417 is employed as liquid reflux 419 for column 407. The remaining part 418 of stream 417, which comprises the equivalent of from about 0 to 60 percent of the first nitrogen-rich vapor fraction 411, is cooled by passage through heat exchangers 436 and 437, and the cooled stream 434 is expanded through valve 435 and introduced into column 421 as liquid reflux. Although not shown, it may be desirable for purposes of safety to withdraw a small liquid stream from condenser 414 and introduce it into column 421 in order to prevent an undesirable buildup of hydrocarbon impurities in the vaporizing liquid of condenser 414. Liquid air streams 426 and 425 are combined into stream 431 which is cooled by passage through heat exchanger 436 and 437 and the resulting cooled stream 432 is expanded through valve 433 and introduced into column 421 as feed.

In column 421 the feed is separated by rectification into a second nitrogen-rich vapor fraction and a second oxygen-enriched liquid fraction. The second oxygen-enriched liquid fraction is partially vaporized in condenser 420 by indirect heat exchange with feed air stream 404 to produce vapor reflux for the medium pressure column. A portion of the second oxygen-enriched liquid fraction is removed from the bottom of medium pressure column 421 as stream 427 which is cooled by passage through heat exchangers 436 and 437 and the cooled stream 428 is expanded through valve 429 and introduced into top condenser 442 at the top of column 421.

The second nitrogen-rich vapor fraction 439 in column 421 is divided into two portions represented by stream 440 and stream 441. Stream 440 comprises from about 0 to 60 percent, preferably from 20 to 50 percent, most preferably from 35 to 45 percent of the second nitrogen-rich vapor fraction 439 and is removed from column 421 warmed by passage through heat exchangers 437, 436, and 444 and desuperheater 400 and recovered as medium pressure nitrogen gas 453 at about ambient temperature. Stream 441 is condensed in condenser 442 by indirect heat exchange with the aforementioned portion of the second oxygen-enriched liquid fraction. The resulting condensed second nitrogen-rich liquid portion 443, together with the aforementioned stream 434, is employed as liquid reflux for the medium pressure column 421. The resulting second oxygen-enriched vapor portion from the indirect heat exchange in condenser 442 is removed from column 421 as stream 454 warmed by passage through heat exchangers 437, 436 and 444 and desuperheater 400 and recovered as product oxygen 457 at about ambient temperature and pressure.

FIG. 1 illustrates a preferred embodiment of the process of this invention wherein a waste stream 445 is removed from column 421 between the points where feed streams 416 and 432 are introduced into column 421. Stream 445 is superheated by passage through heat exchanger 436 and 444 and is then introduced into desuperheater 400 which it partially traverses and from which it is removed as stream 448 at a temperature of from about 150° to 180° K. Stream 448 is expanded through turboexpander 449 and the low pressure cooled stream 450 is warmed in desuperheater 400 and removed at about ambient temperature as stream 451. In this way the waste stream 445 may be used to give added control over the reflux ratio of the medium pressure column 421, to develop plant refrigeration and to aid in the regeneration of ambient temperature adsorbent beds used to preclean feed air streams 401 and 405.

In some circumstances it may be desirable to recover oxygen stream 457 at elevated pressure. The process of this invention can produce oxygen at a pressure of from about 17 to 40 psia. In such a situation columns 407 and 421 would each be operated at the higher end of their respective operating pressure range and stream 454 would be removed from column 421 at a pressure of from about 20 to 45 psia. Alternatively a small fraction of the oxygen could be withdrawn from the bottom of the medium pressure column or from a few equilibrium stages above the bottom and recovered as elevated pressure oxygen. For some applications, it would be desirable to produce some higher purity oxygen, i.e., 99 or 99.5% purity, along with the bulk oxygen product. For those cases, the high purity oxygen can be removed from the bottom of the medium pressure column as either gas or liquid and the bulk oxygen is produced at some point above the bottom of the column. That is, the liquid oxygen stream is removed from the medium pressure column a few trays or separation stages above the bottom and that liquid is then vaporized in the top condenser to produce the bulk oxygen product. Referring to FIG. 1, the liquid stream 427 would be taken off column 421 above the column bottom.

Furthermore, one could develop plant refrigeration in a number of ways other than the way shown in FIG. 1. For example, one could turboexpand one or both of the product nitrogen streams or one could turboexpand the high pressure nitrogen product to the medium pressure and thus recover one nitrogen stream at a single pressure. Also one could turboexpand a feed air stream prior to its introduction to one of the columns. And, one could turboexpand more than one stream, such as a feed air stream and a product stream, if one wished to develop extra refrigeration such as when it is desired to recover one or more product streams as liquid. A small part of the first nitrogen-rich vapor fraction could also be expanded to control air desuperheater temperature profiles and develop plant refrigeration and then introduced to the medium pressure column.

The process of this invention can produce large quantities of elevated pressure nitrogen and also some oxygen. One can carry out the process of this invention so that it is directed to either of these products. As has been stated previously, one can recover from about 0 to 60 percent of the first nitrogen-rich vapor fraction as high pressure nitrogen gas. If one desired to direct the process of this invention to the production of elevated pressure nitrogen gas it is preferable that one recover from 20 to 50 percent, and most preferably from 35 to 45 percent, of the first nitrogen-rich vapor fraction as high pressure nitrogen gas. In such a situation it is preferable that all or nearly all of the first nitrogen-rich liquid portion is employed as reflux for the high pressure column and very little or no part of the first nitrogen-rich liquid portion is employed as reflux for the medium pressure column. If one desired to direct the process of this invention to the production of oxygen, i.e., obtain a higher purity oxygen product, it is preferable that one employ the first nitrogen-rich liquid portion as reflux for the medium pressure column in an amount equivalent to from about 20 to 50 percent, most preferably from about 35 to 45 percent, of the first nitrogen-rich vapor fraction. In such a situation it is preferable that none or very little of the first nitrogen-rich vapor fraction be recovered as high pressure nitrogen gas. Of course, depending on one's purpose, one can direct the process of this invention toward both products and therefore some of the first nitrogen-rich vapor fraction would be recovered and some of the first nitrogen-rich liquid portion would be employed as reflux for the medium pressure column.

In any event, the sum, on a mass basis, of the portion of the first nitrogen-rich vapor fraction recovered as high pressure nitrogen gas and the first nitrogen-rich portion employed as liquid reflux for the medium pressure column should not exceed about 60 percent of the first nitrogen-rich vapor fraction. Preferably said sum is from 20 to 60 percent and most preferably from 30 to 50 percent of the first nitrogen-rich vapor fraction. In this way sufficient reflux will be supplied to the high pressure column to allow it to effectively carry out the separation by rectification.

Table 1 tabulates the results of a computer simulation of the process of this invention carried out in accord with the embodiment of FIG. 1. The stream numbers in Table 1 correspond to those of FIG. 1. The nitrogen product recovered represented about 90 percent of that available from the feed air and the oxygen product recovered represented about 92 percent of that available from the feed air. The computer simulation reported in Table 1 is of the case wherein the process of this invention is directed toward producing an oxygen product of increased purity. In this case none of the first nitrogen-rich vapor fraction is recovered as high pressure nitrogen gas and the entire first nitrogen-rich vapor fraction is condensed in the high pressure column top condenser.

TABLE 1

| Stream | Number | Value |
|---|---|---|
| Feed Air | 405 | |
| Flow, mcfh | | 1,575 |
| Pressure, psia | | 111 |
| Temperature, °K. | | 280 |
| Feed Air | 401 | |
| Flow, mcfh | | 1,575 |
| Pressure, psia | | 159 |
| Temperature, °K. | | 330 |
| Liquid Air to High Pressure Column | 424 | |
| Flow, mcfh | | 1,009 |
| Liquid Air to Medium Pressure Column | 432 | |
| Flow, mcfh | | 566 |
| Oxygen-enriched Vapor | 416 | |
| Flow, mcfh | | 1,720 |
| Purity, percent $O_2$ | | 30 |
| Reflux to Medium Pressure Column | 434 | |
| Flow, mcfh | | 811 |
| Purity, ppm $O_2$ | | 4 |
| Waste Nitrogen | 451 | |
| Flow, mcfh | | 261 |
| Purity, percent $O_2$ | | 19 |
| Pressure, psia | | 20 |
| Temperature, °K. | | 300 |
| Oxygen Product | 457 | |
| Flow, mcfh | | 639 |
| Pressure, psia | | 12 |
| Purity, percent $O_2$ | | 95 |
| Temperature, °K. | | 300 |
| High Pressure Nitrogen Product | 459 | None |
| Medium Pressure Nitrogen Product | 453 | |
| Flow, mcfh | | 2,250 |
| Pressure, psia | | 53 |
| Purity, ppm $O_2$ | | 4 |
| Temperature, °K. | | 300 |

The process of this invention can produce large quantities of elevated pressure nitrogen and also some oxygen because it has the ability to satisfy to reflux ratio requirements for the medium pressure column without limiting the available reflux to that available from the vaporization of the oxygen-enriched stream in the medium pressure column top condenser. This allows the production of relatively high purity oxygen product since added reflux can be obtained as desired from the high pressure column. The amount of reflux available from the high pressure column is dependent on the amount of liquid air added to that column. As more reflux is generated from the high pressure column more liquid air must be added to that column. In a similar fashion, the reflux flow from the high pressure column is related to the ability of the high pressure column to produce high pressure nitrogen product. The total amount of nitrogen liquid reflux and high pressure nitrogen product that can be produced by the high pressure column is determined by the amount of feed air introduced into that column. The greater is the amount of the high pressure nitrogen product recovered the less is the amount available for the generation of reflux liquid. The fraction of the nitrogen-rich vapor which can be condensed to produce reflux liquid is dependent on the amount of liquid air added to the high pressure column.

Figure 2:
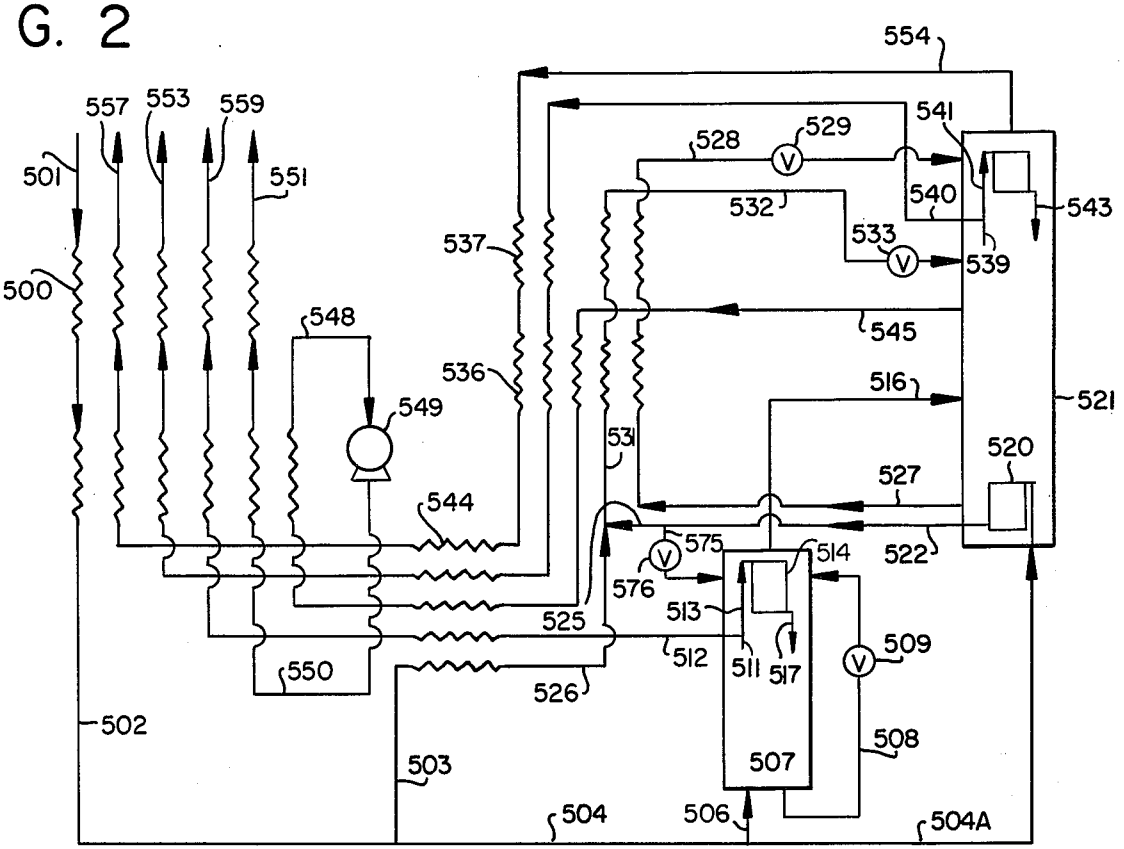
FIG. 2 is a schematic representation of another preferred embodiment of the process of this invention.

In some situations oxygen product may not be desired, or a realatively low purity of oxygen is acceptable. In these situations it is advantageous to minimize the amount of first nitrogen-rich liquid portion employed as reflux for the medium pressure column and employ all of the condensed nitrogen-rich liquid produced in the high pressure column top condenser as reflux for the high pressure column. Such an embodiment is illustrated in FIG. 2. The numerals in FIG. 2 are the same as those for FIG. 1 plus 100 for the elements common to both.

As can be seen from FIG. 2 all of the first nitrogen-rich liquid portion 517 is employed as liquid reflux for the high pressure column. Thus there is no liquid reflux added to the medium pressure column from the first nitrogen-rich liquid portion.

The feed air 504 is divided into a major fraction 506 which is introduced into high pressure column 507 and into a minor fraction 504A which is introduced into condenser 520 where it is condensed by indirect heat exchange with the medium pressure column bottoms so as to produce reflux vapor for the medium pressure column. The resulting condensed liquid air stream 522 is divided into stream 525 and into stream 575 which is expanded through valve 576 and added to column 507 for added refrigeration.

The remainder of the FIG. 2 embodiment is carried out in a similar fashion to that described in detail for the FIG. 1 embodiment. However, as one can see from FIG. 2, one need not supply the feed air to the high pressure column and the main condenser at different pressure levels as is shown in FIG. 1.

Table 2 tabulates the results of a computer simulation of the process of this invention carried out in accord with the embodiment of FIG. 2. The stream numbers in Table 2 correspond to those of FIG. 2. The total nitrogen product recovered represented about 83 percent of that available from the feed air.

TABLE 2

| Stream | Number | Value |
|---|---|---|
| Total Feed Air | 501 | |
| Flow, mcfh | | 3,850 |
| Pressure, psia | | 119 |
| Temperature, °K. | | 280 |
| Column Feed Air | 506 | |
| Flow, mcfh | | 3,080 |
| Pressure, psia | | 116 |

TABLE 2-continued

| Stream | Number | Value |
|---|---|---|
| Condenser Feed Air | 504A | |
| Flow, mcfh | | 645 |
| Pressure, psia | | 115 |
| Superheater Feed Air | 503 | |
| Flow, mcfh | | 125 |
| Pressure, psia | | 116 |
| Waste Nitrogen | 551 | |
| Flow, mcfh | | 357 |
| Purity, percent $O_2$ | | 24 |
| Pressure, psia | | 16 |
| Temperature, °K. | | 277 |
| Waste Oxygen | 557 | |
| Flow, mcfh | | 976 |
| Pressure, psia | | 15 |
| Purity, percent $O_2$ | | 74 |
| Temperature, °K. | | 277 |
| High Pressure Nitrogen Product | 559 | |
| Flow, mcfh | | 1,394 |
| Purity, ppm $O_2$ | | 4 |
| Pressure, psia | | 110 |
| Temperature, °K. | | 277 |
| Medium Pressure Nitrogen Product | 553 | |
| Flow, mcfh | | 1,124 |
| Purity, ppm $O_2$ | | 4 |
| Pressure, psia | | 53 |
| Temperature, °K. | | 277 |

As one can see from the description of the process of this invention, purity of the oxygen obtained is related to the amount of liquid reflux obtained from the high pressure column. As one desires oxygen of greater purity one must obtain greater amounts of liquid reflux from the high pressure column for the medium pressure column, in lieu of reflux generated by vaporizing liquid oxygen in the medium pressure column top condenser. At the same time this means that the system requires some additional separation power. However, when one does not desire oxygen of such higher purity, all or most the reflux for the medium pressure column is supplied by vaporizing oxygen-enriched liquid in the medium pressure column top condenser.

The percentage of feed air fed to the main condenser and high pressure column respectively will vary and will depend on the desired product or products and on whether an air stream is used to heat returning streams as shown in FIGS. 1 and 2. Generally the gaseous feed air introduced into high pressure column will be from about 40 to 80 percent of the total feed air, preferably from about 50 to 70 percent, and the gaseous feed air introduced into the main condenser will be from about 20 to 60 percent of the total feed air, preferably from about 30 to 50 percent. The percentage of the liquid air emerging from the main condenser which is introduced to the high pressure column and medium pressure column respectively will vary and will depend on the desired product or products and on whether an air stream is used to heat returning streams. Generally from 40 to 70 percent of the condensed liquid air from the main condenser will be supplied to the medium pressure column with the remainder supplied to the high pressure column, preferably from 50 to 60 percent.

The process of this invention can efficiently produce large amounts of elevated pressure nitrogen at a purity exceeding about 99 percent and generally exceeding 99.9 percent while recovering from about 60 to 90 percent of the nitrogen available from the feed air and also, if desired, can produce some oxygen at a purity of from about 57 to 97 percent. Also, if desired, one can recover a stream of oxygen having a purity greater than 97 percent, and up to about 99.5 percent.

Although the process of this invention has been described in detail with reference to preferred embodiments, those skilled in the art will recognize that there are many other embodiments of the process which can be practiced and which are within the spirit and scope of the claims.

I claim:

1. A process for the production of nitrogen gas at greater than atmospheric pressure by the separation of air by rectification comprising:

(A) introducing cleaned, cooled feed air at greater than atmospheric pressure into a high pressure column operating at a pressure of from about 80 to 300 psia;

(B) separating said feed air by rectification in said high pressure column into a first nitrogen-rich vapor fraction and a first oxygen-enriched liquid fraction;

(C) recovering from about 0 to 60 percent of said first nitrogen-rich vapor fraction as high pressure nitrogen gas at a purity exceeding about 99 percent;

(D) condensing at least a portion of said first nitrogen-rich vapor fraction by indirect heat exchange with said first oxygen-enriched liquid fraction thereby producing a first nitrogen-rich liquid portion and a first oxygen-enriched vapor fraction;

(E) employing at least some of said first nitrogen-rich liquid portion as liquid reflux for said high pressure column;

(F) introducing said first oxygen-enriched vapor fraction into a medium pressure column operating at a pressure, lower than that of said high pressure column, of from about 40 to 150 psia;

(G) separating said first oxygen-enriched vapor fraction by rectification in said medium pressure column into a second nitrogen-rich vapor fraction and at least some oxygen in the form of a second oxygen-enriched liquid fraction;

(H) vaporizing a portion of said second oxygen-enriched liquid fraction by indirect heat exchange with cleaned, cooled feed air at a pressure of from about 80 to 350 psia, thereby producing a first oxygen-enriched vapor portion, for use as vapor reflux in said medium pressure column, and liquid air;

(I) dividing said liquid air into a first part which is introduced into said high pressure column wherein it is separated by rectification into parts which comprise the first nitrogen-rich vapor fraction and the first oxygen-enriched liquid fraction, and into a second part, which is introduced into said medium pressure column wherein it is separated by rectification into parts which comprise the second nitrogen-rich vapor fraction and the second oxygen-enriched liquid fraction;

(J) recovering up to 60 percent of said second nitrogen-rich vapor fraction as medium pressure nitrogen gas at a purity exceeding about 99 percent;

(K) condensing at least a portion of said second nitrogen-rich vapor fraction by indirect heat exchange with a portion of said second oxygen-enriched liquid fraction thereby producing a second oxygen-enriched vapor portion and a second nitrogen-rich liquid portion;

(L) employing said second nitrogen-rich liquid portion as liquid reflux for said medium pressure column;

(M) employing said first nitrogen-rich liquid portion as additional liquid reflux for said medium pressure column in an amount equivalent to that of from about 0 to 60 percent of said first nitrogen-rich vapor fraction such that the sum of said amount and of the high pressure nitrogen gas recovered in step (C) is from about 0 to 60 percent of said first nitrogen-rich vapor fraction; and (N) removing from the process said second oxygen-enriched vapor portion having an oxygen purity of from 57 to 97 percent.

2. The process of claim 1 wherein all of said first nitrogen-rich liquid portion of step (E) is employed as liquid reflux for said high pressure column.

3. The process of claim 1 wherein in step (M) said sum is from about 20 to 60 percent of said first nitrogen-rich vapor fraction.

4. The process of claim 1 wherein in step (M) said sum is from about 30 to 50 percent of said first nitrogen-rich vapor fraction.

5. The process of claim 1 wherein in step (C) from about 20 to 50 percent of said first nitrogen-rich vapor fraction is recovered as high pressure nitrogen gas.

6. The process of claim 1 wherein in step (C) from about 35 to 45 percent of said first nitrogen-rich vapor fraction is recovered as high pressure nitrogen gas.

7. The process of claim 1 wherein in step (C) none of said first nitrogen-rich vapor fraction is recovered as high pressure nitrogen gas.

8. The process of claim 1 wherein said high pressure column is operating at a pressure of from about 90 to 240 psia.

9. The process of claim 1 wherein said high pressure column is operating at a pressure of from about 100 to 200 psia.

10. The process of claim 1 wherein said medium pressure column is operating at a pressure of from about 45 to 120 psia.

11. The process of claim 1 wherein said medium pressure column is operating at a pressure of from about 50 to 90 psia.

12. The process of claim 1 wherein in step (J) from about 20 to 50 percent of said second nitrogen-rich vapor fraction is recovered as medium pressure nitrogen gas.

13. The process of claim 1 wherein in step (J) from about 35 to 45 percent of said second nitrogen-rich vapor fraction is recovered as medium pressure nitrogen gas.

14. The process of claim 1 wherein in step (M) said amount is from about 20 to 50 percent of said first nitrogen-rich vapor fraction.

15. The process of claim 1 wherein in step (M) said amount is from about 35 to 45 percent of said first nitrogen-rich vapor fraction.

16. The process of claim 1 wherein a nitrogen-rich vapor stream is removed from said medium pressure column at a point intermediate the respective points where said first oxygen-enriched vapor fraction and said second liquid air part are introduced into said medium pressure column, and is warmed, expanded and removed from the process.

17. The process of claim 1 wherein said second oxygen-enriched vapor portion is recovered as product.

18. The process of claim 1 wherein said second oxygen-enriched vapor portion comprises from 57 to 97 percent oxygen.

19. The process of claim 1 wherein said feed air of step (H) is at a pressure exceeding the pressure of said feed air of step (A).

20. The process of claim 1 wherein said feed air of step (H) is at the same pressure as the pressure of said feed air of step (A).

21. The process of claim 1 wherein a further portion of said second oxygen-enriched liquid fraction is removed from the medium pressure column and recovered as product oxygen having an oxygen concentration exceeding 97 percent.

22. The process of claim 21 wherein said further portion is vaporized prior to recovery.

* * * * *

UNITED STATES PATENT AND TRADEMARK OFFICE

CERTIFICATE OF CORRECTION

PATENT NO. : 4,448,595

DATED : May 15, 1984

INVENTOR(S) : Harry Cheung

It is certified that error appears in the above-identified patent and that said Letters Patent is hereby corrected as shown below:

In column 2, line 24, delete "50" and insert therefore -- 150 --.

In column 8, line 22, delete "realatively" and insert therefore -- relatively --.

Signed and Sealed this

*Eighteenth* Day of *September 1984*

[SEAL]

*Attest:*

GERALD J. MOSSINGHOFF

*Attesting Officer*

*Commissioner of Patents and Trademarks*